US007153093B2

(12) United States Patent
Dreifert et al.

(10) Patent No.: US 7,153,093 B2
(45) Date of Patent: Dec. 26, 2006

(54) VACUUM PUMP

(75) Inventors: Thomas Dreifert, Kerpen (DE); Wolfgang Giebmanns, Erfstadt (DE); Hans-Rochus Gross, Bergisch Gladbach (DE); Hartmut Kriehn, Köln (DE)

(73) Assignee: Leybold Vacuum GmbH, Colonge (DE)

( * ) Notice: Subject to any disclaimer, the term of this patent is extended or adjusted under 35 U.S.C. 154(b) by 0 days.

(21) Appl. No.: 10/505,608

(22) PCT Filed: Feb. 18, 2003

(86) PCT No.: PCT/EP03/01598

§ 371 (c)(1),
(2), (4) Date: Feb. 11, 2005

(87) PCT Pub. No.: WO03/071134

PCT Pub. Date: Aug. 28, 2003

(65) Prior Publication Data

US 2005/0147517 A1 Jul. 7, 2005

(30) Foreign Application Priority Data

Feb. 23, 2002 (DE) ..... 102 07 929

(51) Int. Cl.
*F04C 27/00* (2006.01)

(52) U.S. Cl. ..... 415/112; 415/229

(58) Field of Classification Search ..... 415/112, 415/111, 229

See application file for complete search history.

(56) References Cited

U.S. PATENT DOCUMENTS 4,196,910 A * 4/1980 Aizu ..... 277/419
4,734,018 A * 3/1988 Taniyama et al. ..... 417/423.4
5,836,753 A 11/1998 Takei et al. ..... 418/95

(Continued)

FOREIGN PATENT DOCUMENTS

BE 1010821 2/1999

(Continued)

*Primary Examiner*—Edward K. Look
*Assistant Examiner*—Nathan Wiehe
(74) *Attorney, Agent, or Firm*—Fay, Sharpe, Fagan, Minnich & McKee, LLP

(57) ABSTRACT

A vacuum pump (10) comprises at least one rotor shaft (12) having a rotor section (14) with a rotor (16), a bearing section (18) with a bearing (20), and a shaft sealing system (22) that is axially situated between the rotor section (14) and the bearing section (18). The shaft sealing system (22) axially comprises, on the side of the rotor, a gas seal (32) and, on the side of the bearing, an oil seal (34). The shaft sealing system (22) additionally comprises, between the gas seal (32) and the oil seal (34), a separating chamber, which surrounds the rotor shaft (12) and is ventilated by at least one separating chamber ventilation duct (60, 62). This enables the pressure difference that decreases via the gas seal and the pressure difference that decreases via the oil seal to be adjusted. An appropriate adjustment can prevent oil on the bearing side from passing through the oil seal toward the separating chamber.

19 Claims, 2 Drawing Sheets

U.S. PATENT DOCUMENTS

| | | | | |
|---|---|---|---|---|
| 6,095,780 | A | 8/2000 | Ernens | 418/104 |
| 6,287,100 | B1 | 9/2001 | Achtelik et al. | 418/104 |
| 6,969,229 | B1 * | 11/2005 | Beccaluva et al. | 415/112 |

FOREIGN PATENT DOCUMENTS

| | | | |
|---|---|---|---|
| BE | 1011349 | | 7/1999 |
| DE | 3720250 | | 1/1988 |
| DE | 19963170 | | 6/2001 |
| DE | 29522263 | U1 | 8/2001 |
| EP | 0 874 158 | A1 | 10/1998 |
| JP | 61-104187 | | 5/1986 |
| JP | 63-285279 | | 11/1988 |

* cited by examiner 10
14
22
60
18
28
30
44
36
48
20
59
26
16
24
40
38
50
52
42
32
II
34
12
38
40
40
58
48
46
62
64
II

VACUUM PUMP

BACKGROUND OF THE INVENTION

The invention relates to a vacuum pump with at least one rotor shaft having a rotor section with a rotor, a bearing section with a bearing, and a shaft sealing system that is axially situated between the rotor section and the bearing section.

Such vacuum pumps may be configured, among other things, as screw pumps, side channel compressor, and Roots pumps. The mentioned vacuum pumps have in common that they are dry compressing vacuum pumps with oil- or grease-lubricated bearings and/or gears. Typically, these pumps are employed to generate a fore-vacuum. The task of the seal arrangement between the actual rotor and the bearing and the gear, respectively is, on the one hand, avoiding that gas passes from the rotor section to the bearing section and, on the other hand, avoiding that liquid passes from the bearing section into the rotor section. At low rotor speeds and small rotor shaft diameters, relatively good sealing contacting seals can be used, e.g., in the form of radial shaft sealing rings, sliding rings and so forth. At higher rotational speeds and larger rotor shaft diameters, only contactless shaft seals can be used which, however, cannot completely exclude leakages because of their construction.

A known contactless shaft sealing system consists of one or more piston sealing rings as a gas seal and an oil splash ring as an oil seal. They are unable, however, to achieve a reliable and high sealing effect. The gas compressed in the rotor section, however, is not to come into contact with the oil from the bearing section since the oil might be decomposed thereby and thus may lose its oiliness. The leaking oil, gas or gas mixture may also be toxic or explosive and therefore dangerous.

Therefore, it is an object of the invention to improve the shaft seal in a vacuum pump, comprising a gas seal and an oil seal.

SUMMARY OF THE INVENTION

In the vacuum pump according to one aspect of the invention, the shaft seal system is configured such that a separating chamber surrounding the rotor shaft is provided between the rotor-side gas seal and the bearing-side oil seal, said separating chamber being ventilated by at least one separating chamber ventilation duct. Through the ventilation duct, the separating chamber is adjusted to a desired gas pressure. This enables the pressure difference that appears at the gas seal and the pressure difference that appears at the oil seal to be adjusted. Thus, the separating chamber may be pressurized by, e.g. atmospheric gas pressure or by the bearing-side gas pressure through the ventilation duct so that the gas pressure in the separating chamber is not below the bearing-side gas pressure. Thereby, oil can be prevented from migrating from the bearing side through the oil seal toward the separating chamber. With respect to the gas pressure on the rotor side of the gas seal, the separating chamber gas pressure may be set to be higher so that explosive and/or toxic gases from the rotor section cannot escape through the gas seal. Thus, a shaft sealing system is realized which prevents gas from escaping from the rotor section into the bearing section and oil from escaping from the bearing section into the rotor section in a simple and reliable manner even with gas and oil seals that are not completely tight for reasons of construction. Only small manufacturing efforts and space are required for the separating chamber so that a compact and effective shaft sealing system is realized with small means.

According to a preferred embodiment, the separating chamber ventilation duct opens into the surrounding atmosphere outside the pump. Thus, atmospheric pressure and the same gas pressure as in the bearing housing always prevails in the separating chamber when the latter is also ventilated toward the environment. Then, the pressure difference at the oil seal actually equals zero so that no oil from the bearing section is pressed towards the separating chamber and the rotor section, respectively, because of the lacking pressure difference.

According to a preferred embodiment, the gas seal and the oil seal are configured as contactless seals, respectively. Thereby, the shaft sealing system can also be employed in vacuum pumps with high rotational speeds and high rotor shaft diameters.

Preferably, the gas seal is configured as a diaphragm gland or as a labyrinth seal, with piston rings or with floating sealing rings. In any case, the gas seal is a contactless throttle seal that reduces the gas passage to an unavoidable minimum.

Preferably, the labyrinth seal of the gas seal comprises at least one piston ring that projects into an annular groove of the rotor shaft. The piston ring is outwardly biased and therefore fixed and stationary on the side of the housing. The piston ring projects into the annular groove of the rotor shaft whereby a labyrinth-like extending gap is formed between the piston ring and the annular groove, acting as a throttle seal. The gas seal may comprise several of such labyrinth seals arranged axially one after another.

Preferably, the oil seal on the rotor shaft comprises a circumferential oil splash ring that projects into an annular centrifugal chamber on the side of the housing, which is connected to an oil return duct to the bearing housing. Thus, an effective contactless oil seal is created.

According to a preferred embodiment, radial and/or axial non-conical or conical gaps are formed between the oil splash ring and the centrifugal chamber walls on the side of the housing. The oil splash ring and the opposite stationary walls are configured such that the entering oil is outwardly thrown off when the rotor shaft is rotating and the oil which has not been thrown off drains off downwards into the return duct.

Preferably, the oil seal comprises, on the axial rotor side, at least one annular reception chamber with an oil drain duct opening into the bearing housing. The oil seal has two or more centrifugal or reception chambers with an oil drain duct arranged one after another. The oil drain ducts can be combined in a single duct, but each splash or reception chamber may also have a separate oil drain duct of its own allocated thereto. Thereby, mutual interferences during the drain of oil are excluded so that the oil seal is only slightly influenced in its sealing effect upon disturbances in an oil drain duct.

According to a preferred embodiment, a seal gas source is connected to the separating chamber ventilation duct, through which a seal gas is introduced under overpressure into the separating chamber. This may be required and useful if toxic and/or explosive gases are supplied in the rotor section. By the introduction of the seal gas, a small seal gas flow from the separating chamber toward the rotor section is created. Thus, the leakage of gas from the rotor section can be avoided. As a seal gas, air or nitrogen, for example, can be used. By the introduction of seal gas into the separating chamber, the separating chamber pressure is increased with respect to the pressure in the bearing section or the bearing housing.

Preferably, each centrifugal or reception chamber of the oil seal has at least one ventilation duct allocated thereto. The ventilation duct may be led outwards toward the atmosphere, preferably, however, it should be led back to the bearing housing. The centrifugal chambers can be ventilated via a single common ventilation duct or rather via at least one ventilation duct of their own, respectively. By means of the ventilation through the ventilation ducts, it is ensured that no pressure difference is created even within the oil seal, i.e., between the individual centrifugal chambers. Thus, a gas flow and thus an entrainment of oil in the direction of the separating chamber or rotor section is practically excluded. Therefore, the transfer of gases from the separating chamber towards the bearing housing is largely prevented.

According to a preferred embodiment, the separating chamber ventilation duct opens near the lowest point of the separating chamber and has a descendent gradient so that liquid that might possibly leak is able to drain off the separating chamber. Even if oil or other liquids from the bearing section or the rotor section should reach the separating chamber, it could drain off to the outside. Thereby, it is ensured that no liquid can accumulate in the separating chamber.

Preferably, the bearing has a configuration so as to be covered axially on the rotor side. Thereby, a first barrier for oil or other liquids from the bearing is already realized between the bearing and the shaft sealing system.

According to a preferred embodiment, a seal gas source is connected to the separating chamber ventilation duct, through which a seal gas is introduced under overpressure into the separating chamber. This is required and useful if toxic and/or explosive gases are supplied in the rotor section. By the introduction of the seal gas, a small seal gas flow from the separating chamber toward the rotor section is created. Thus, the leakage of gas from the rotor section can be avoided. As a seal gas, air or nitrogen, for example, can be used. By the introduction of seal gas into the separating chamber, the separating chamber pressure is increased with respect to the pressure in the bearing section or the bearing housing.

In order to avoid any pressure difference between the bearing section and the separating chamber, a seal gas duct from the seal gas source to the bearing housing or the bearing section may be additionally provided. Thus, it is ensured that no mentionable pressure difference is produced across the oil seal. The seal gas has a pressure of 1.3 bar, for example.

According to a preferred embodiment, the rotor shaft is configured as a floating rotor shaft borne only at the pressure side of the rotor section, but is configured without a bearing on the suction side of the rotor section of the rotor shaft. Thus, a bearing in the region of lower low pressures is avoided so that the shaft sealing system on the suction side of the rotor shaft, which is problematic at large pressure difference, is also avoided. Floating rotor shafts have a relatively large shaft diameter for reasons of stability. By the present shaft sealing system and the provision of a separating chamber between the gas seal and the oil seal only, the high circumferential speeds associated with large rotor shaft diameters can be sealed without having to accept an unreasonably large leakage.

Still further advantages of the present invention will be appreciated to those of ordinary skill in the art upon reading and understand the following detailed description.

Brief Description of the Drawings

The invention may take form in various components and arrangements of components, and in various steps and arrangements of steps. The drawings are only for purposes of illustrating the preferred embodiments and are not to be construed as limiting the invention.

DETAILED DESCRIPTION OF THE PREFERRED EMBODIMENTS

Figure 1:
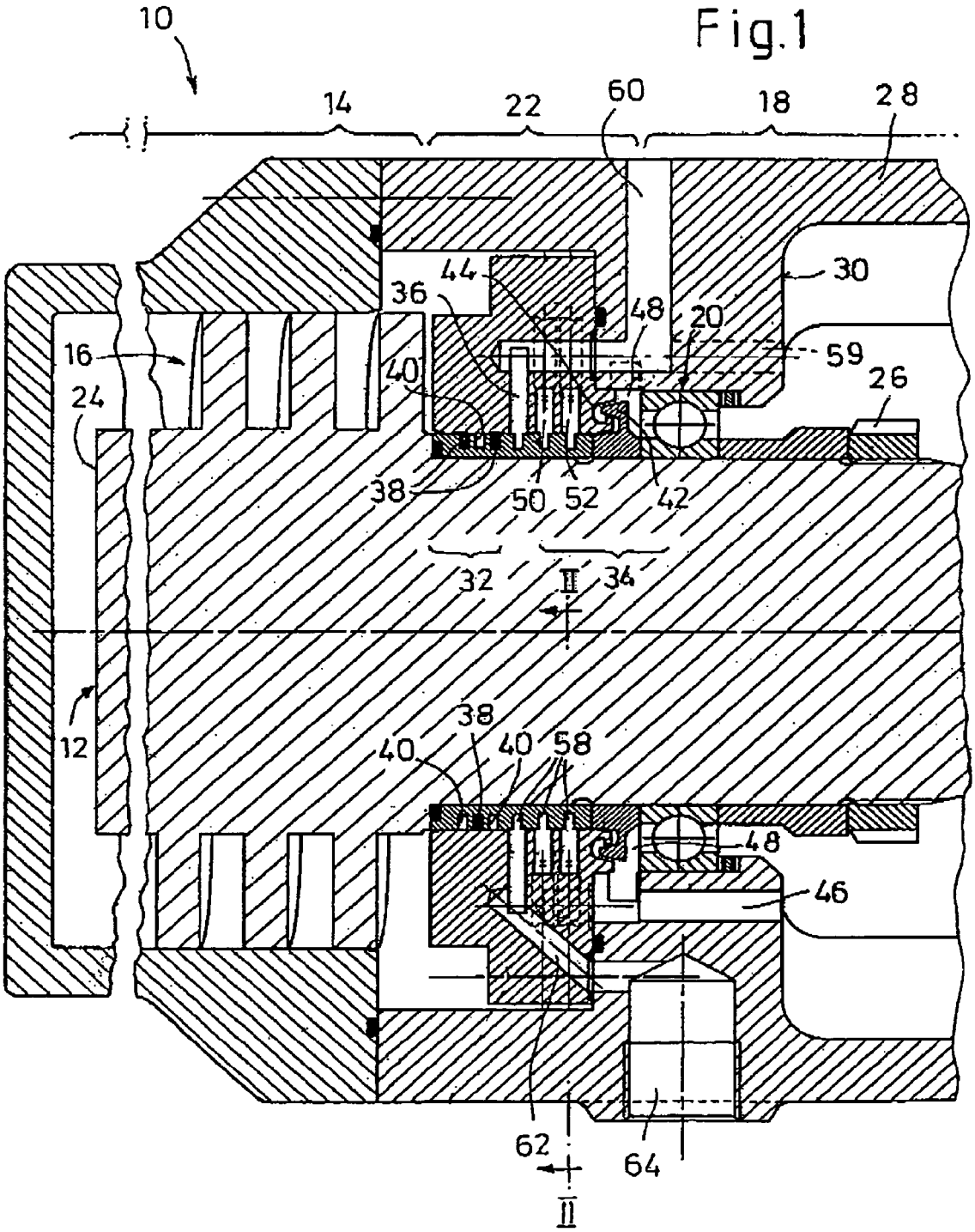
FIG. 1 shows a vacuum propeller pump in longitudinal section.
Figure 2:
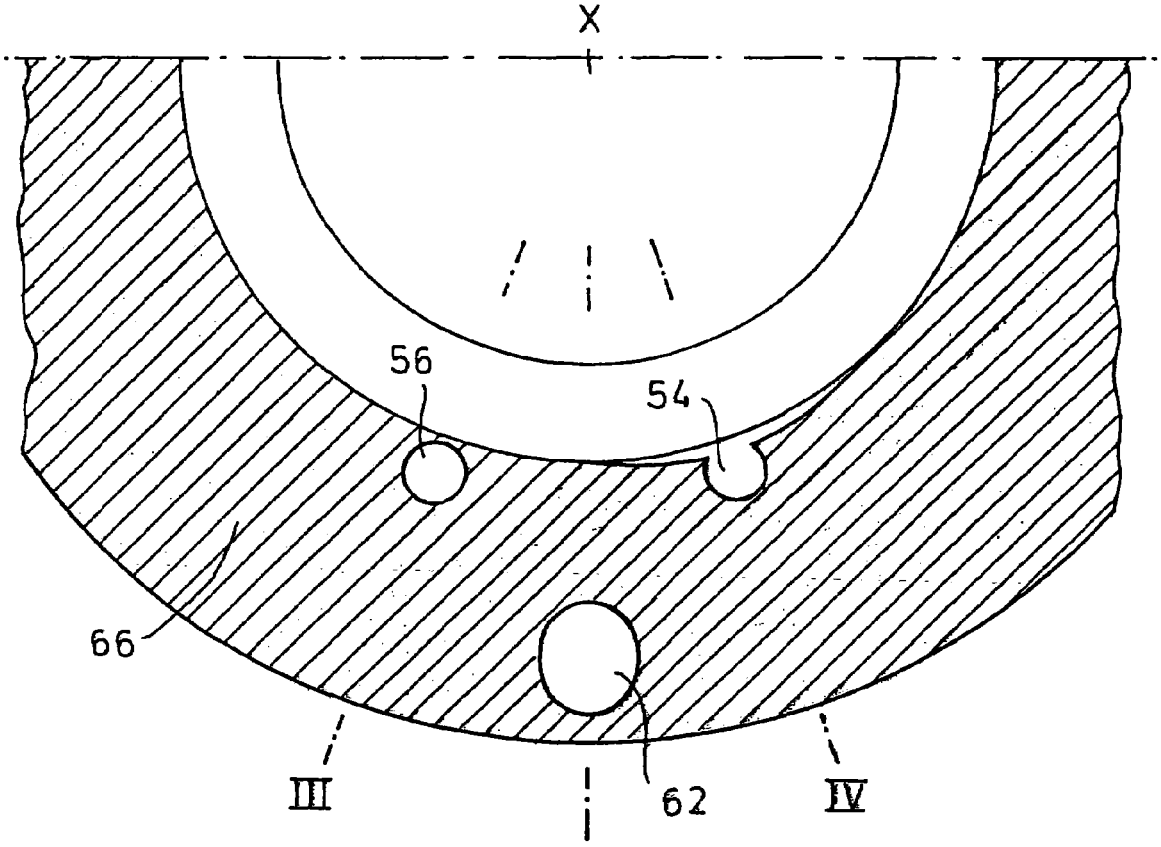
FIG. 2 shows the housing of the propeller vacuum pump of FIG. 1 in cross section.
Figure 3:
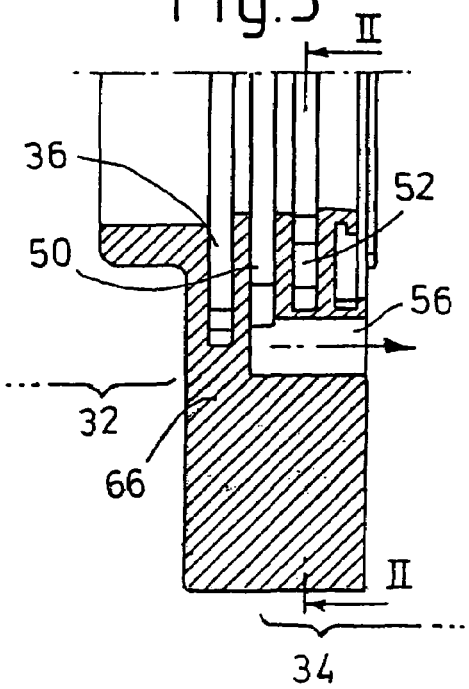
FIG. 3 shows a cutout of a longitudinal section along the section line X-III of the pump housing of FIG. 2.
Figure 4:
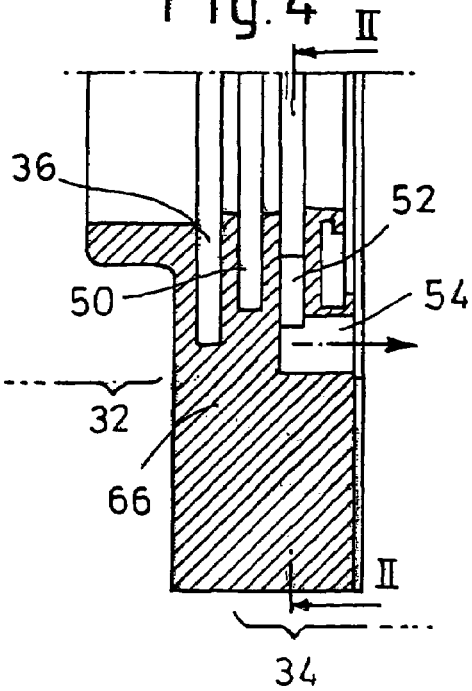
FIG. 4 shows a longitudinal section of the pump housing of FIG. 2 along the section line X-IV.

The vacuum pump 10 illustrated in FIGS. 1 to 4 is a screw vacuum pump for producing a fore-vacuum. The vacuum pump 10 is substantially formed by a housing in which two rotor shafts are rotatably supported from which only the main rotor shaft 12 is illustrated in FIGS. 1–4. The rotor shaft 12 comprises a rotor section 14 with a screw-shaped rotor 16, a bearing section 18 with two rolling bearings 20 and, axially between the rotor section 14 and the bearing section 18, a section with a shaft sealing system 22. No rolling bearing is provided at the rotor-side end 24 of the rotor shaft 12.

By rotating the screw-shaped rotors, a gas is sucked through a non-illustrated suction line at the floating ends thereof to thus produce a negative pressure in a recipient connected to the suction line. By cooperation of the illustrated rotor 16 with a second rotor of a second non-illustrated rotor shaft, the sucked gas is compressed towards the pressure side of the rotor section 14 and there, it is carried off via a non-illustrated gas outlet at about atmospheric pressure.

In the bearing section 18 of the rotor shaft 12, two rolling bearings are provided for a rotatable bearing, only the rolling bearing 20 on the rotor side being illustrated. Further, the rotor shaft 12 comprises a gearwheel 26 in the bearing section 18, via which the rotor shaft 12 is driven. The bearing housing interior 30 formed by the bearing housing 28 includes an oil supply for lubricating and cooling the rolling bearings 20 and the one or more gears 26.

Substantially, the shaft sealing system has three axial sections, i.e., a gas seal 32 on the rotor side, an oil seal 34 on the bearing side and a separating chamber 36 between them. The shaft sealing system 22 is surrounded by a sealing housing.

The gas seal 32 is formed by three piston rings 38 arranged axially one after another. The piston rings 38 are outwardly biased and therefore, they are force-fit connected with the stationary housing. Each of the piston rings 38 extends into an annular groove 40 of the rotor shaft 12 which results in a gap extending in a meandering manner in longitudinal section due to the three piston rings 38 in the annular grooves 40. Thus, a contactless labyrinth seal is formed ensuring a satisfactory gas seal at pressure differentials of less than 0.5 bar.

The oil seal 34 consists of several parts. The bearing-side section of the oil seal 34 comprises an oil splash ring 42 on the side of the rotor shaft, having a waved profile in longitudinal section. Thereby and by a correspondingly complimentary configuration of the housing 44 surrounding the oil splash ring 42, it is ensured that upon the rotor shaft 12 rotating, the oil from the bearing section 18 is thrown off outwardly through the rotating oil splash ring 42 and let off downwardly through a corresponding stationary launder from where it has to drain off through an oil return duct 46 back into the bearing housing. On the side of the housing, the oil splash ring 42 is surrounded by an annular centrifugal chamber 48 for receiving and letting off the oil thrown outwards by the oil splash ring 42 through the oil return duct 46. Axially succeeding the oil splash ring 42 on the rotor side, the oil seal 34 comprises two annular oil reception chambers 50,52 each of which has a circumferential annular groove 58 allocated thereto on the side of the rotor shaft. The oil centrifugal chamber 48 is of larger volume than the two axially succeeding oil reception chambers 50,52.

Each of the annularly circumferential centrifugal chamber 48 as well as the oil reception chambers 50,52, which have an annular configuration as well, has its own ventilation duct 59 near its highest point, leading into the bearing housing 28 in axial direction, respectively. In circumferential direction, the three ventilation ducts 59 are arranged so as to be offset with respect to each other. Near their lowest points, each of the two oil reception chambers 50,52 has an oil return duct 54,56 through which oil has come this far can flow back into the bearing housing 28, if necessary. Alternatively, while doing without one or even both oil reception chambers 50,52, the annular grooves 58 of the rotor shaft 12 may also have piston rings inserted thereinto to avoid that oil which axially creeps farther in the direction of the rotor.

The annular separating chamber 36 between the gas seal 32 and the oil seal 34, which has a relatively large volume, comprises a separating chamber ventilation duct 60 near its highest point through which the separating chamber is ventilated to the ambience or through which it is connected with a seal gas source. On the side of the separating chamber, the separating chamber ventilation duct 60 comprises an axial section and thereafter, at right angles thereto, a radial section leading to the outside. There is no pressure difference and no oil is pressed through the oil seal in the direction of the rotor by a pressure difference since the bearing housing is ventilated to the ambience or also has the same seal gas pressure applied thereto as the separating chamber.

Near the lowest point of the separating chamber 36, another separating chamber ventilation duct 62 is provided which has a descendent gradient and opens into a vertical drain 64. The separating chamber ventilation duct 62 also serves as a drain for oil which might have possibly come this far or for liquids from the rotor section.

By providing the separating chamber 36, it is ensured in a simple and compact manner that neither fluids from the rotor section 14 can reach the bearing section 18 nor fluids from the bearing section 18 can reach the rotor section 14.

The invention has been described with reference to the preferred embodiments. Modifications and alterations may occur to others upon reading and understanding the preceding detailed description. It is intended that the invention be constructed as including all such modifications and alterations insofar as they come within the scope of the appended claims or the equivalents thereof

The invention claimed is:

1. A vacuum pump comprising:

at least one rotor shaft having a rotor section with a rotor. a bearing section with a bearing, and a shaft sealing system that is axially situated between the rotor section and the bearing section, the shaft sealing system axially comprising:

on the side of the rotor, a gas seal, on the side of the bearing, an oil seal, and between the gas seal and the oil seal, a separating chamber surrounding the rotor shaft and being ventilated by at least one separating chamber ventilation duct, the separating chamber ventilation duct connecting the interior of the vacuum pump into the surrounding atmosphere.

2. The vacuum pump according to claim 1, wherein the gas seal and the oil seal are contactless seals.

3. The vacuum pump according to claim 1, wherein the gas seal is one of a diaphragm gland or a labyrinth seal.

4. The vacuum pump according to claim 2, wherein the gas seal is a labyrinth seal including at least one piston ring projecting into an annular groove of the rotor shaft.

5. The vacuum pump according claim 1, wherein the oil seal comprises:

a circumferential oil splash ring at the rotor shaft which projects into an annular centrifugal chamber on the side of the housing, said chamber being connected by an oil return duct to the bearing housing.

6. A vacuum pump comprising at least one rotor shaft having a rotor section with a rotor, a bearing section with a bearing, and a shaft sealing system that is axially situated between the rotor section and the bearing section the shaft sealing system comprising:

on the side of the rotor, a gas seal, a circumferential oil splash ring at the rotor shaft which projects into an annular centrifugal chamber on the side of the housing, on the side of the bearing, an oil seal, the oil seal comprising:

on the rotor side of the oil splash ring, at least one annular oil reception chamber, at least one oil drain duct leading from the reception and centrifugal chambers into a bearing housing surrounding the bearing, and between the gas seal and the oil seal, a separating chamber surrounding the rotor shaft and being ventilated by at least one separating chamber ventilation duct.

7. A vacuum pump comprising:

at least one rotor shaft having a rotor section with a rotor, a bearing section with a bearing, and a shaft sealing system that is axially situated between the rotor section and the bearing section, the shaft sealing system axially comprising:

on the side of the rotor, a gas seal;

on the side of the bearing, an oil seal, a circumferential oil splash ring at the rotor shaft which projects into an annular centrifugal chamber on the side of the housing, said chamber being connected by an oil return duct to the bearing housing, each reception and centrifugal chamber of the oil seal having at least one ventilation duct allocated thereto, and between the gas and the oil seal, a separating chamber surrounding the rotor shaft and being ventilated by at least one separating chamber ventilation duct.

8. The vacuum pump according to claim 7. wherein one of radial or axial conical or non-conical gaps are provided between the oil splash ring and centrifugal chamber walls on the side of a housing. housing, each reception and centrifugal chamber of the oil seal having at least one ventilation duct allocated thereto, and between the gas and the oil seal, a separating chamber surrounding the rotor shaft and being ventilated by at least one separating chamber ventilation duct.

9. The vacuum pump according to claim 7, wherein the rotor shaft is floatingly supported and free of a bearing at a suction side of the rotor section.

10. The vacuum pump according to claim 7, wherein the separating chamber ventilation duct connects the interior of the vacuum pump into the surrounding atmosphere.

11. The vacuum pump according to claim 7, wherein the gas seal and the oil seal are contactless seals.

12. The vacuum pump according to claim 7, wherein the gas seal is one of a diaphragm gland or a labyrinth seal.

13. The vacuum pump according to claim 7, wherein the gas seal is a labyrinth seal including at least one piston ring projecting into an annular groove of the rotor shaft.

14. A vacuum pump comprising:

at least one rotor shaft having a rotor section with a rotor, a bearing section with a bearing, and a shaft sealing system that is axially situated between the rotor section and the bearing section, the shaft sealing system comprising:

on the side of the rotor, a gas seal, on the side of the bearing, an oil seal, between The gas seal and the oil seal, a separating chamber surrounding the rotor shaft; and at least one separating chamber ventilation duct which ventilates the separating chamber, the separating chamber ventilation duct opens in a region of a lowest point of the separating chamber and has a descendent slope so that liquid is able to drain from the separating chamber.

15. The vacuum pump according to claim 14, wherein The bearing is axially covered on a side toward the rotor.

16. The vacuum pump according to claim 14, wherein a seal gas source is connected to the separating chamber ventilation duct to introduce a seal gas into the separating chamber under overpressure.

17. The A vacuum pump comprising:

at least one rotor shaft having a rotor section with a rotor, a bearing section with a bearing, and a shaft sealing system that is axially situated between the rotor section and the bearing section, the shaft sealing system comprising:

on the side of the rotor, a gas seal, on the side of the bearing, an oil seal, between the gas seal and the oil seal, a separating chamber surrounding the rotor shaft and being ventilated by at least one separating chamber ventilation duct; and a seal gas source is connected to a ventilation duct and a housing of the bearing section such that in the separating chamber and the bearing housing, approximately the same pressure prevails.

18. The vacuum pump according to claim 17, wherein the oil seal comprises:

at least one piston ring preventing oil from passing into the separating chamber via a pressure gradient from the separating chamber to a bearing housing.

19. In a vacuum pump which includes at least one rotor shaft having a rotor section with a rotor, a bearing section with a bearing, and a shaft sealing system axially situated between the rotor section and the bearing section, which shaft sealing system includes a rotor side gas seal and a bearing side oil seal, a method of preventing oil from the bearing section from entering the rotor section comprising:

introducing a gas between the gas seal and the oil seal and into the bearing section at a pressure to equalize pressure across the bearing.

* * * * *